US009417582B1

(12) United States Patent
Urayama et al.

(10) Patent No.: US 9,417,582 B1
(45) Date of Patent: Aug. 16, 2016

(54) IMAGE FORMING APPARATUS INCLUDING A CONTROLLER THAT CONTROLS SUPERPOSITION OF A CORRECTION TONER IMAGE

(71) Applicant: FUJI XEROX CO., LTD., Tokyo (JP)

(72) Inventors: Kenta Urayama, Kanagawa (JP); Yasuaki Watanabe, Kanagawa (JP); Jun Abe, Kanagawa (JP); Tomoyuki Yoshii, Kanagawa (JP); Toshihiro Kanematsu, Kanagawa (JP); Takashi Ochi, Kanagawa (JP); Shinji Okuyama, Kanagawa (JP); Fumiyuki Honda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/814,664

(22) Filed: Jul. 31, 2015

(30) Foreign Application Priority Data

Mar. 9, 2015 (JP) ..... 2015-046152

(51) Int. Cl.
*G03G 15/00* (2006.01)
*G03G 15/08* (2006.01)

(52) U.S. Cl.
CPC ..... *G03G 15/5062* (2013.01); *G03G 15/0822* (2013.01)

(58) Field of Classification Search
CPC ..... G03G 15/5062; G03G 15/0822
USPC ..... 399/72
See application file for complete search history.

(56) References Cited

U.S. PATENT DOCUMENTS 8,849,134 B2 * 9/2014 Ogawa ..... G03G 15/5058 399/72

FOREIGN PATENT DOCUMENTS

JP 2010-048921 A 3/2010

* cited by examiner

*Primary Examiner* — William J Royer
(74) *Attorney, Agent, or Firm* — Sughrue Mion, PLLC

(57) ABSTRACT

An image forming apparatus includes an image forming section and a controller. The image forming section transfers a toner image to a transfer target and includes plural developing units. The plural developing units include a first developing unit and at least one second developing unit. The plural developing units each include an image holding body and a developing roller. The image holding body has an outer circumferential surface and is rotated. The controller controls the image forming section so that, when a low-area-coverage portion and a high-area-coverage portion are disposed adjacent to each other and are formed by the first developing unit, a correction toner image is superposed on a boundary portion, where the low-area-coverage portion and the high-area-coverage portion are adjacent to each other, by the at least one second developing unit.

7 Claims, 10 Drawing Sheets

FIG. 7

| WITHOUT CORRECTION TONER IMAGE | M2=M1−20% M3=M2/6 | M2=M1−15% M3=M2/6 | M2=M1−10% M3=M2/6 | M2=M1−5% M3=M2/6 | M2=M1 M3=M2/6 | M2=M1+5% M3=M2/6 | M2=M1+10% M3=M2/6 |
|---|---|---|---|---|---|---|---|
| B | B | A | A | A | A | A | B |

| WITHOUT CORRECTION TONER IMAGE | LENGTH =0.5 mm | LENGTH =1.0 mm | LENGTH =1.5 mm |
|---|---|---|---|
| B | A | A | B |

IMAGE FORMING APPARATUS INCLUDING A CONTROLLER THAT CONTROLS SUPERPOSITION OF A CORRECTION TONER IMAGE

CROSS-REFERENCE TO RELATED APPLICATIONS

This application is based on and claims priority under 35 USC 119 from Japanese Patent Application No. 2015-046152 filed Mar. 9, 2015.

BACKGROUND

Technical Field

The present invention relates to an image forming apparatus.

SUMMARY

According to an aspect of the present invention, an image forming apparatus includes an image forming section and a controller. The image forming section transfers a toner image to a transfer target and includes plural developing units. The plural developing units include a first developing unit and at least one second developing unit. The plural developing units each include an image holding body and a developing roller. The image holding body has an outer circumferential surface and is rotated. The developing roller holds developer, faces the image holding body, and is rotated in an opposite direction to a rotating direction of the image holding body such that an outer circumferential speed of the developing roller is higher than an outer circumferential speed of the image holding body. The controller controls the image forming section so that, when a low-area-coverage portion having a low area coverage and a high-area-coverage portion having a higher area coverage than the low area coverage are disposed adjacent to each other and are formed by the first developing unit, a correction toner image is superposed on a boundary portion, where the low-area-coverage portion and the high-area-coverage portion are adjacent to each other, by the at least one second developing unit.

BRIEF DESCRIPTION OF THE DRAWINGS

Exemplary embodiments of the present invention will be described in detail based on the following figures, wherein:

FIG. 7 is a table that summarizes results of a first experiment;

DETAILED DESCRIPTION

An example of an image forming apparatus according to an exemplary embodiment of the present invention is described.

The Structure of an Image Forming Apparatus

Figure 1:
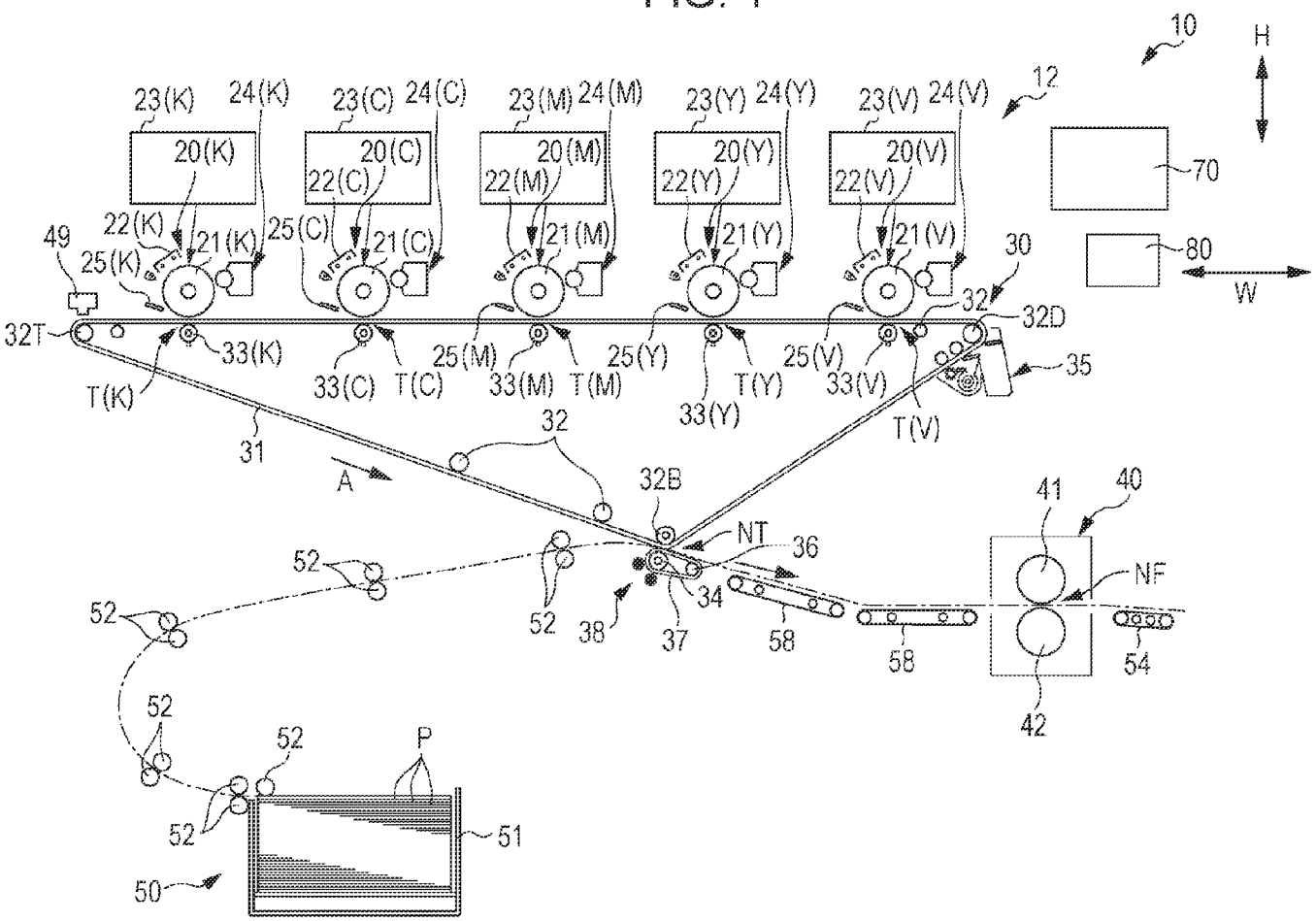
FIG. 1 is a schematic view of the structure of an image forming apparatus according to an exemplary embodiment.
Figure 5:
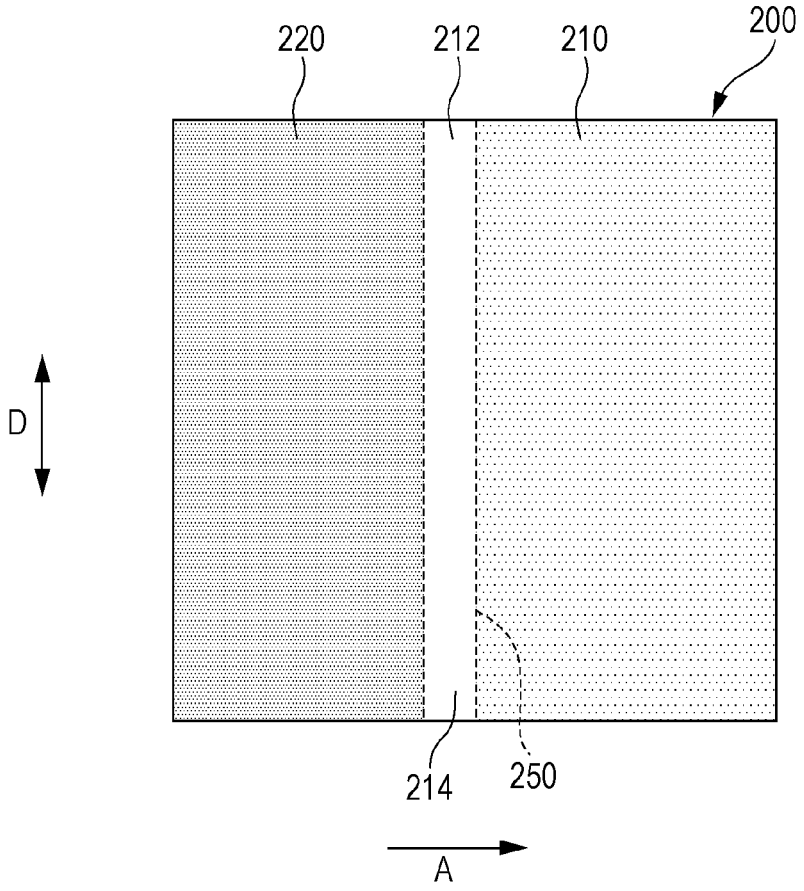
FIG. 5 is a plan view of a low-density portion generated in the boundary portion of the low-area-coverage portion that is the boundary with the high-area-coverage portion on the upstream side in the gold toner image.

FIG. 1 is a schematic view of the structure of an image forming apparatus 10 seen in a rotational axis direction of photosensitive drums 21(V), 21(Y), 21(M), 21(C), and 21(K) and an intermediate transfer belt 31, which will be described later. An "axial direction", which will be described later, refers to this rotational axis direction, and a width direction D of FIG. 5 is also the same as this axial direction. As illustrated in FIG. 1, the image forming apparatus 10 includes an image forming section 12, a transport device 50, a transfer device 30, a fixing device 40, a controller 70, and a power unit 80. The image forming section 12 forms toner images by an electrophotographic method. The transport device 50 transports recording media P. The transfer device 30 transfers the toner images onto the recording media P. The fixing device 40 fixes the toner images onto the recording media P. The controller 70 controls operations of components of the image forming apparatus 10. The power unit 80 supplies power to the components.

The Transport Device

As illustrated in FIG. 1, the transport device 50 includes a container unit 51 and plural transport rollers 52. The container unit 51 contains the recording media P. The transport rollers 52 transport each of the recording media P from the container unit 51 to a second transfer position NT, which will be described later. The transport device 50 further includes plural transport belts 58 and a transport belt 54. The transport belts 58 transport the recording medium P from the second transfer position NT to the fixing device 40. The transport belt 54 transports the recording medium P from the fixing device 40 toward an output unit (not illustrated) for the recording medium P.

The Image Forming Section

The image forming section 12 includes plural toner image forming units 20(V), 20(Y), 20(M), 20(C), and 20(K) that each form a toner image and transfer the toner image onto the intermediate transfer belt 31 through first transfer.

The Toner Image Forming Units

The plural toner image forming units 20(V), 20(Y), 20(M), 20(C), and 20(K) are provided so that each of the toner image forming units 20(V), 20(Y), 20(M), 20(C), and 20(K) forms the toner image of a corresponding one of colors and transfers the toner image onto the intermediate transfer belt 31. According to the present exemplary embodiment, the toner image forming units 20(V), 20(Y), 20(M), 20(C), and 20(K) are provided for a total of five colors, that is, a special color (V), yellow (Y), magenta (M), cyan (C), and black (K). Signs (V), (Y), (M), (C), and (K) indicate components corresponding to the above-described respective colors. These signs may be described only by characters V, Y, M, C, and K with the parentheses of (V), (Y), (M), (C), and (K) omitted in the description herein. Furthermore, in the description where the colors are not distinguished, V, Y, M, C, and K are appropriately omitted.

The toner image forming units 20 for these colors, that is, the special color (V), yellow (Y), magenta (M), cyan (C), and black (K) are arranged in this order from an upstream side toward a downstream side in a transport direction of the intermediate transfer belt 31, which will be described later. In the present exemplary embodiment, a "gold toner" is used for the special color (V).

Figure 2:
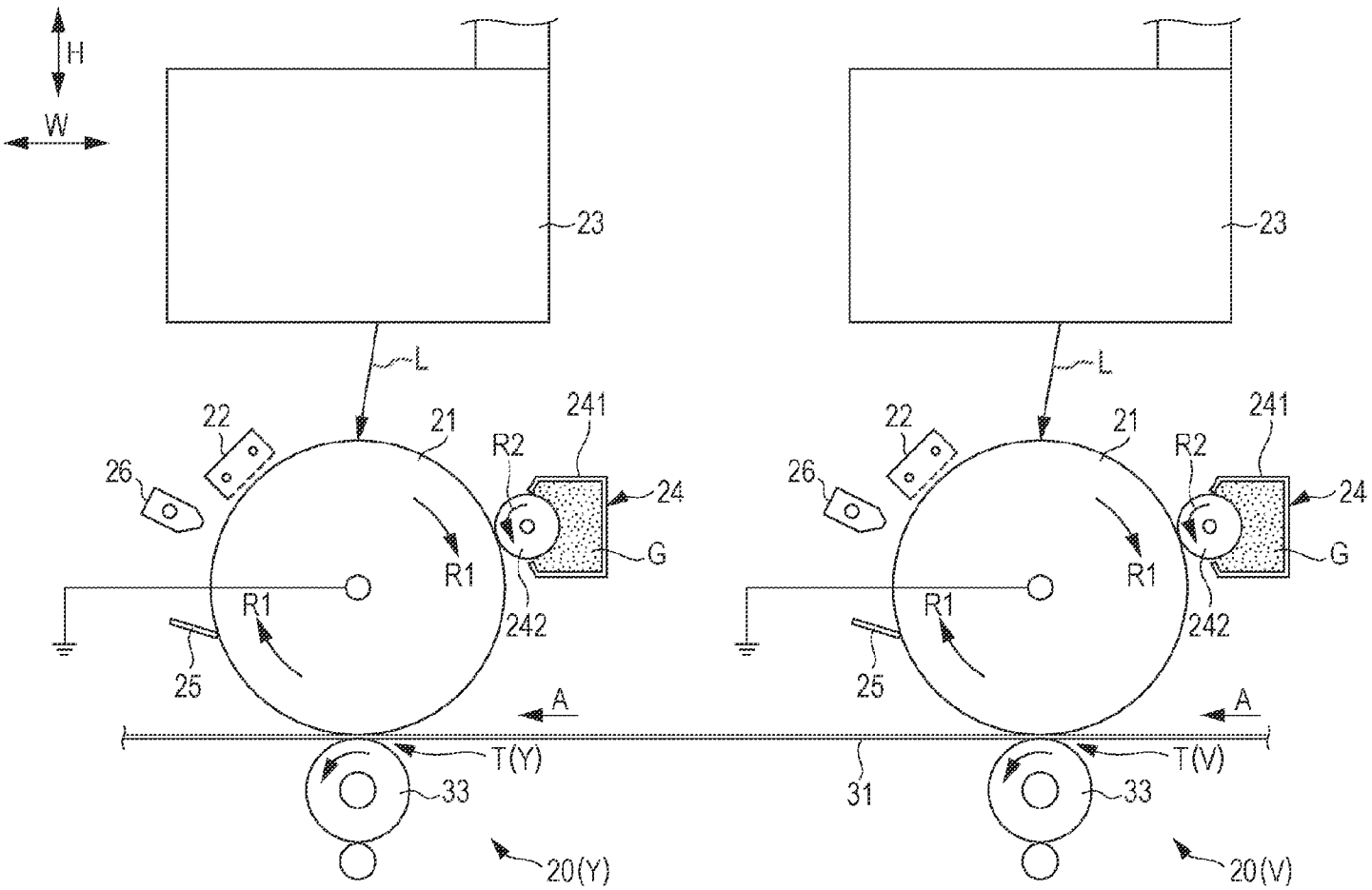
FIG. 2 is a schematic view of a toner image forming section according to the present exemplary embodiment.

The structures of the toner image forming units 20 for the colors are generally similar to or the same as one another except for the toner used therein. Specifically, each of the toner image forming units 20 for the colors includes, as illustrated in FIG. 2, a corresponding one of the photosensitive drums 21 and a charger 22. The photosensitive drum 21 serves as an example of an image holding body and is rotated clockwise in FIG. 2. The charger 22 charges the photosensitive drum 21.

The toner image forming unit 20 for the color further includes a light exposure device 23, a developing device 24, a photosensitive body cleaner 25, and a static eliminator 26. The light exposure device 23 causes the photosensitive drum 21 charged by the charger 22 to be exposed to light so as to form an electrostatic latent image on the photosensitive drum 21. The developing device 24 develops the electrostatic latent image formed on the photosensitive drum 21 by the light exposure device 23 so as to form the toner image.

The Developing Device

As illustrated in FIG. 2, the developing device 24 includes a container 241 and a developing roller 242. Developer G is contained in the container 241. Due to a potential difference generated between the developing roller 242 and the photosensitive drum 21 by applying a developing bias voltage to the developing roller 242, the electrostatic latent image formed on an outer circumferential surface of the photosensitive drum 21 becomes visible as a toner image. The developing device 24 will be described later.

The Photosensitive Body Cleaner

The photosensitive body cleaner 25 includes a blade. The toner remaining on the surface of the photosensitive drum 21 after the first transfer of the toner image onto the intermediate transfer belt 31 has been performed is scraped off from the surface of the photosensitive drum 21 by the blade.

The Transfer Device

The transfer device 30 transfers the toner images from the photosensitive drums 21 for the respective colors onto the intermediate transfer belt 31 (an example of an intermediate transfer body) through the first transfer such that the toner images are superposed on one another. The transfer device 30 transfers the superposed toner images onto the recording medium P at the second transfer position NT through second transfer.

Intermediate Transfer Belt

The volume resistivity of the intermediate transfer belt 31 according to the present exemplary embodiment is set to $10^{10}$ Ωcm or more. As illustrated in FIG. 1, the intermediate transfer belt 31 is an endless belt and looped over plural rollers 32, 32B, 32D, and 32T. The roller 32D functions as a drive roller that rotates the intermediate transfer belt 31 in an arrow A direction by using power from a motor (not illustrated).

By rotating the intermediate transfer belt 31 in the arrow A direction, the toner images for the colors transferred from the photosensitive drums 21 for the colors at respective first transfer positions T through the first transfer are superposed on one another, and the superposed toner images are transported to the second transfer position NT. The toner images having been transferred to the second transfer position NT are transferred to the recording medium P by a second transfer device 38 through the second transfer.

The roller 32T functions as a tension applying roller that applies tension to the intermediate transfer belt 31. The roller 32B functions as a facing roller 32B that faces a second transfer roller 34, which will be described later.

A cleaner 35 that cleans the intermediate transfer belt 31 is disposed at a position that is downstream of the second transfer position NT and upstream of the first transfer position T (V) in a rotational direction (arrow A direction) of the intermediate transfer belt 31.

The First Transfer Rollers

First transfer rollers 33, which are disposed inside the intermediate transfer belt 31, transfer the toner images on the respective photosensitive drums 21 onto the intermediate transfer belt 31. Each of the first transfer rollers 33 faces a corresponding one of the photosensitive drums 21 for the colors with the intermediate transfer belt 31 interposed therebetween. By applying a first transfer voltage, the polarity of which is opposite to the polarity of the toner, to each of the first transfer rollers 33, the toner image formed on each of the photosensitive drums 21 is transferred onto the intermediate transfer belt 31 at a corresponding one of the first transfer positions T.

The Second Transfer Device

The second transfer device 38 transfers the toner images superposed on one another on the intermediate transfer belt 31 onto the recording medium P. The second transfer device 38 includes a second transfer belt 37. The second transfer belt 37 is an endless belt and looped over the second transfer roller 34 and a driven roller 36.

The second transfer roller 34 is disposed such that the intermediate transfer belt 31 and the second transfer belt 37 are interposed between the second transfer roller 34 and the aforementioned facing roller 32B. The second transfer belt 37 and the intermediate transfer belt 31 are in contact with each other at a predetermined load. A nip between the second transfer belt 37 and the intermediate transfer belt 31 that are in contact with each other as described above serves as the second transfer position NT.

The recording medium P is supplied from the container unit 51 to this second transfer position NT at appropriate timing. The second transfer belt 37 is rotated by rotating the second transfer roller 34.

According to the present exemplary embodiment, when transferring the toner images from the intermediate transfer belt 31 onto the recording medium P, a negative voltage is applied to the facing roller 32B by the power unit 80. This generates a potential difference between the facing roller 32B and the second transfer roller 34. That is, by applying the negative voltage to the facing roller 32B, a second transfer voltage (positive voltage), the polarity of which is opposite to the polarity of the toner, is indirectly applied to the second transfer roller 34, which serves as a counter electrode of the facing roller 32B. This causes the toner images to be transferred from the intermediate transfer belt 31 to the recording medium P passing through the second transfer position NT.

The Fixing Device

The fixing device 40 fixes the toner images onto the recording medium P onto which the toner images have been transferred. Specifically, the fixing device 40 heats and applies pressure to the toner images in a fixing nip NF formed between a heating roller 41 and a pressure roller 42 so as to fix the toner images onto the recording medium P.

Image Forming Operation

Next, an outline of image forming steps performed on the recording medium P by the image forming apparatus 10 is described.

In response to an image forming instruction, the controller 70 causes the toner image forming units 20, the second transfer device 38, and the fixing device 40 to operate in the image forming apparatus 10 illustrated in FIG. 1. The controller 70 also causes the transport device 50 and the like to operate in synchronization with the operations of the toner image forming units 20, the second transfer device 38, and the fixing device 40.

The photosensitive drums 21 for the colors are charged by the respective chargers 22 while being rotated. Furthermore, the controller 70 causes image data having undergone image processing performed by an image signal processing unit to be transmitted to the exposure devices 23. Each of the exposure devices 23 radiates exposure light L (see FIG. 2) in accordance with the image data so as to cause a corresponding one of the charged photosensitive drums 21 to be exposed to the exposure light L. Thus, an electrostatic latent image is formed on the outer circumferential surface of each of the photosensitive drums 21. The electrostatic latent images formed on the photosensitive drums 21 are developed by the respective developing devices 24. Thus, the toner images of the special color (V), yellow (Y), magenta (M), cyan (C), and black (K) are formed on the photosensitive drums 21 for the respective colors.

The toner images of the colors formed on the photosensitive drums 21 for the respective colors are sequentially transferred onto the rotating intermediate transfer belt 31 by the first transfer rollers 33 for the respective colors at the respective first transfer positions T through the first transfer. Thus, superposed toner images formed by superposing the toner images on one another are formed on the intermediate transfer belt 31. These superposed toner images are transported to the second transfer position NT by rotating the intermediate transfer belt 31. The recording medium P is fed to this second transfer position NT by the transport rollers 52 at timing adjusted to transportation of the superposed toner images. The superposed toner images are transferred from the intermediate transfer belt 31 onto the recording medium P at this second transfer position NT through the second transfer.

The recording medium P onto which the toner images have been transferred through the second transfer is transported toward the fixing device 40 by the transport belts 58 while being sucked to the transport belts 58 by a negative pressure. The fixing device 40 applies heat and pressure to the recording medium P passing through the fixing nip NF. Thus, the toner images having been transferred onto the recording medium P are fixed onto the recording medium P.

The recording medium P onto which the toner images have been fixed by the fixing device 40 is transported by the transport belt 54 and output to the output unit (not illustrated).

Meanwhile, residual toner that has not been transferred through the second transfer and remains on the intermediate transfer belt 31 is removed by the cleaner 35.

The Structures of the Components

Next, the structures of the components according to the present exemplary embodiment are described.

The Developing Devices

Initially, the developing devices 24 are described. It is noted that, in FIG. 3, carrier GA, toner GB, and a magnetic brush GC included in the developer G, which will be described later, are illustrated on an enlarged scale. Furthermore, the developing devices 24 according to the present exemplary embodiment each have the structure that is the same as or similar to that of a known developing device of a two-component development type.

Figure 3:
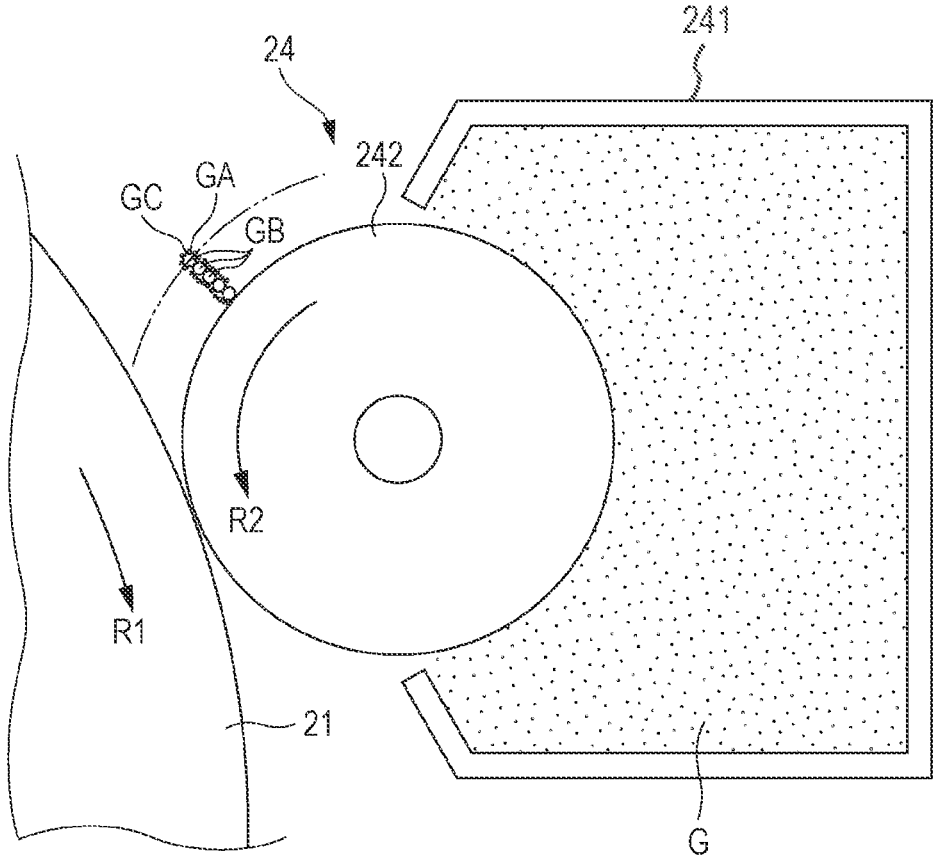
FIG. 3 is a schematic view of one of developing devices of the toner image forming section.

As illustrated in FIG. 3, each of the developing devices 24 includes the developing roller 242, and the developer G is contained in the container 241.

The developing roller 242 is a magnetic roller in which a magnetic body (not illustrated) is disposed in a roller body (not illustrated). Furthermore, the developing roller 242 faces a corresponding one of the photosensitive drums 21 that is rotated, and the roller body is rotated in an arrow R2 direction opposite to a rotational direction R1 of the photosensitive drum 21. The circumferential speed of the roller body of the developing roller 242 is higher than that of the photosensitive drum 21. The magnetic body (not illustrated) in the roller body is rotated in a direction opposite to that of the roller body.

The developer G is a so-called two-component developer including the carrier GA having magnetic properties and the toner GB colored in a corresponding one of the colors. The carrier GA is charged to the positive polarity and the toner GB is charged to the negative polarity in the developer G according to the present exemplary embodiment.

Since the developing roller 242 is the magnetic roller in which the magnetic body (not illustrated) is disposed in the roller body as described above, the carrier GA to which the toner GB is attracted by an electrostatic force is held on an outer circumferential surface of the roller body of the developing roller 242 by a magnetic force.

In the developing device 24 having such a structure, the developer G held by the roller body of the developing roller 242 forms a magnetic brush GC. Also, the developer G (magnetic brush GC) is moved in the same direction as that of an outer circumferential surface of the photosensitive drum 21 at a speed higher than that of the outer circumferential surface of the photosensitive drum 21 in a nip (portion in contact with the photosensitive drum 21) between the magnetic brush GC (developer G) and the photosensitive drum 21 (also see FIGS. 6A to 6C).

The electrostatic latent image on the photosensitive drum 21 is developed by a so-called reversal development method in the nip (see FIGS. 6A to 6C) of the developing device 24 so that the electrostatic latent image becomes visible as the toner image. The developing bias is applied to the developing roller 242 by the power unit 80 (see FIG. 1).

Toner

Figure 10A:
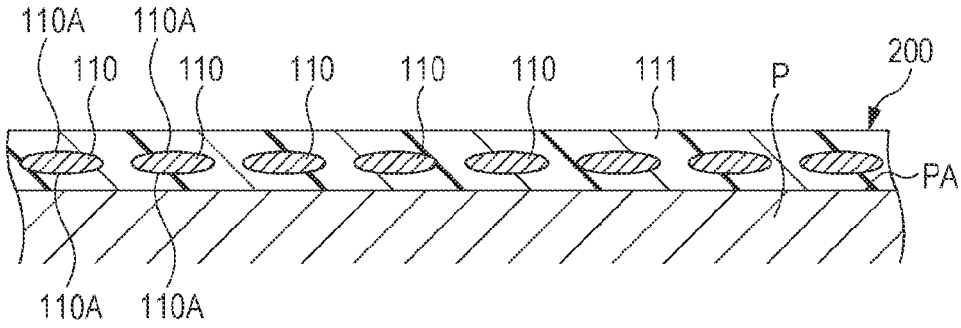
FIGS. 10A and 10B are respectively a sectional view and a plan view of a toner image schematically illustrating a position of flat pigment particles.
Figure 10B:
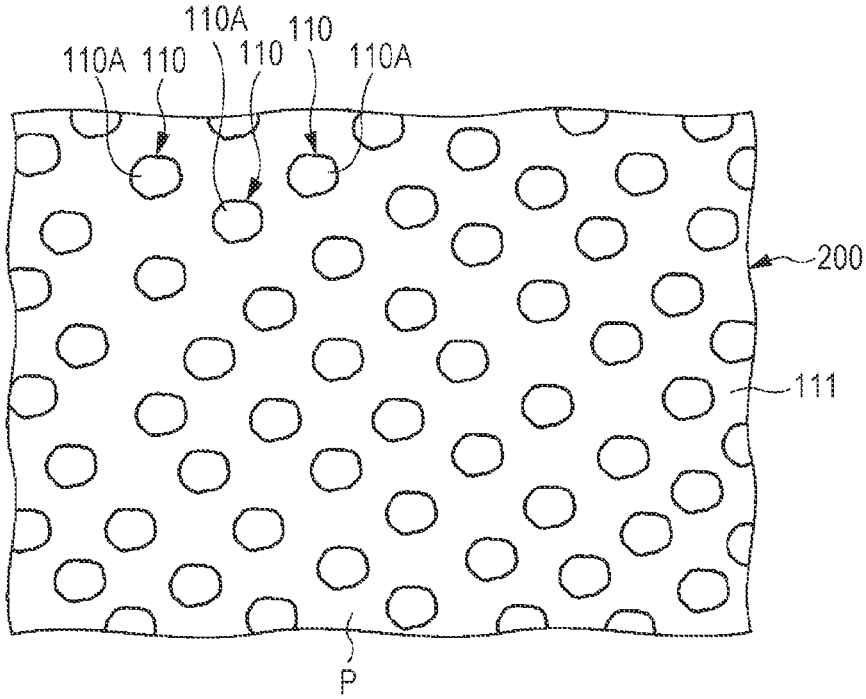

As illustrated in FIGS. 10A and 10B, the gold toner used for the special color (V) includes metal pigment particles 110 that each serve as an example of a flat pigment, a yellow (Y) pigment (not illustrated), and binder resin 111. The gold toner is used to give a metallically glossy appearance to images.

As illustrated in FIG. 10A, the gold toner is arranged in a direction along a sheet surface PA with reflective surfaces 110A of the metal pigment particles 110 facing in a direction perpendicular to the sheet surface PA. That is, the reflective surfaces 110A of the metal pigment particles 110 assume positions in which directions of the reflective surfaces 110A of the metal pigment particles 110 follow the direction of the sheet surface PA of the recording medium P. Thus, a direction of reflected light reflected by an image 200 closely follows the direction perpendicular to the sheet surface PA of the recording medium P.

This may improve the flop index (FI), which is an index that represents the metallically glossy appearance (that is, the metallically glossy appearance may be improved).

The images to which the metallically glossy appearance is given include images formed only of the gold toner and images formed of the gold toner and the toners other than the gold toner.

The metal pigment particles 110 according to the present exemplary embodiment are made of aluminum. Furthermore, as illustrated in FIG. 11B, when one of the metal pigment particles 110 is placed on a flat surface and seen from a side, the dimensions of the metal pigment particle 110 are longer in the left-right direction than in the up-down direction in FIG. 11B.

Figure 11A:
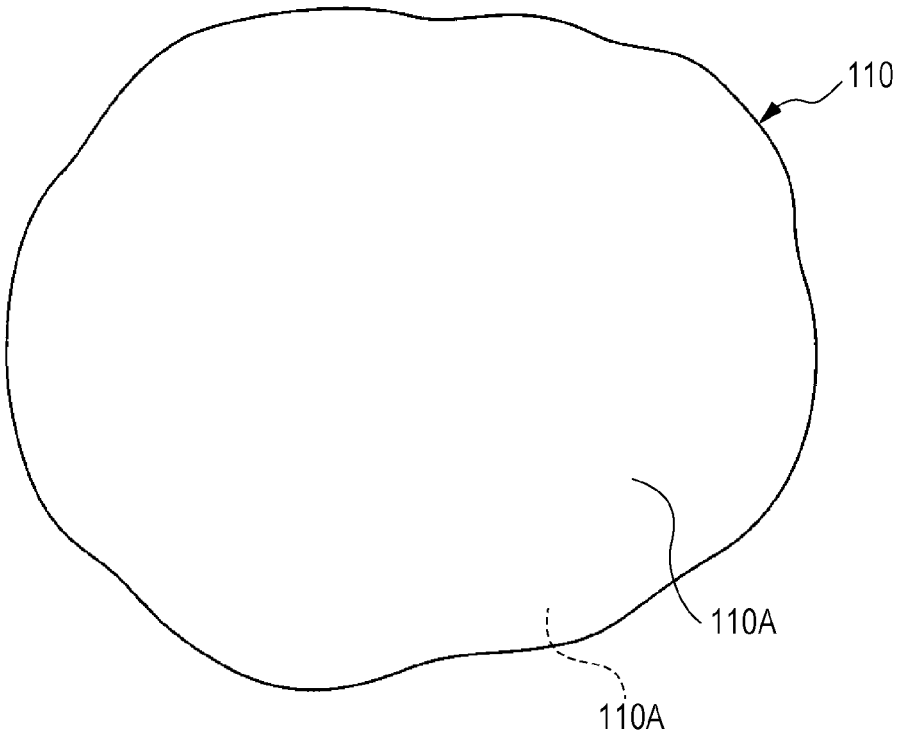
FIGS. 11A and 11B are a plan view and a side view schematically illustrating one of the flat pigment particles included in toner.
Figure 11B:
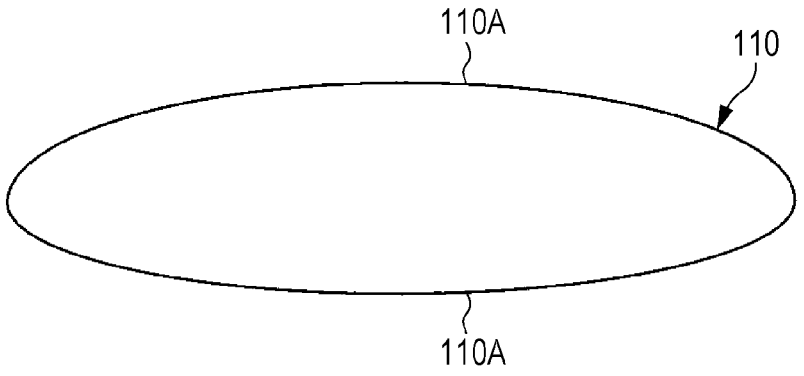

Furthermore, when the metal pigment particle 110 is seen from above in FIG. 11B, the shape of the metal pigment particle 110 is enlarged as illustrated in FIG. 11A compared to that seen from the side. In a state in which the metal pigment particle 110 is placed on a flat surface (see FIG. 11B), the metal pigment particle 110 has a pair of reflective surfaces 110A (flat surfaces), one and the other of which respectively face upward and downward. As has been described, the metal pigment particles 110 have a flat shape.

Although it is not illustrated, the toners of the colors other than gold (toners of the other colors), that is, the toners of yellow (Y), magenta (M), cyan (C), and black (K) include binder resin and pigment particles (for example, organic pigment particles or inorganic pigment particles) other than flat pigment particles.

Control

Figure 4:
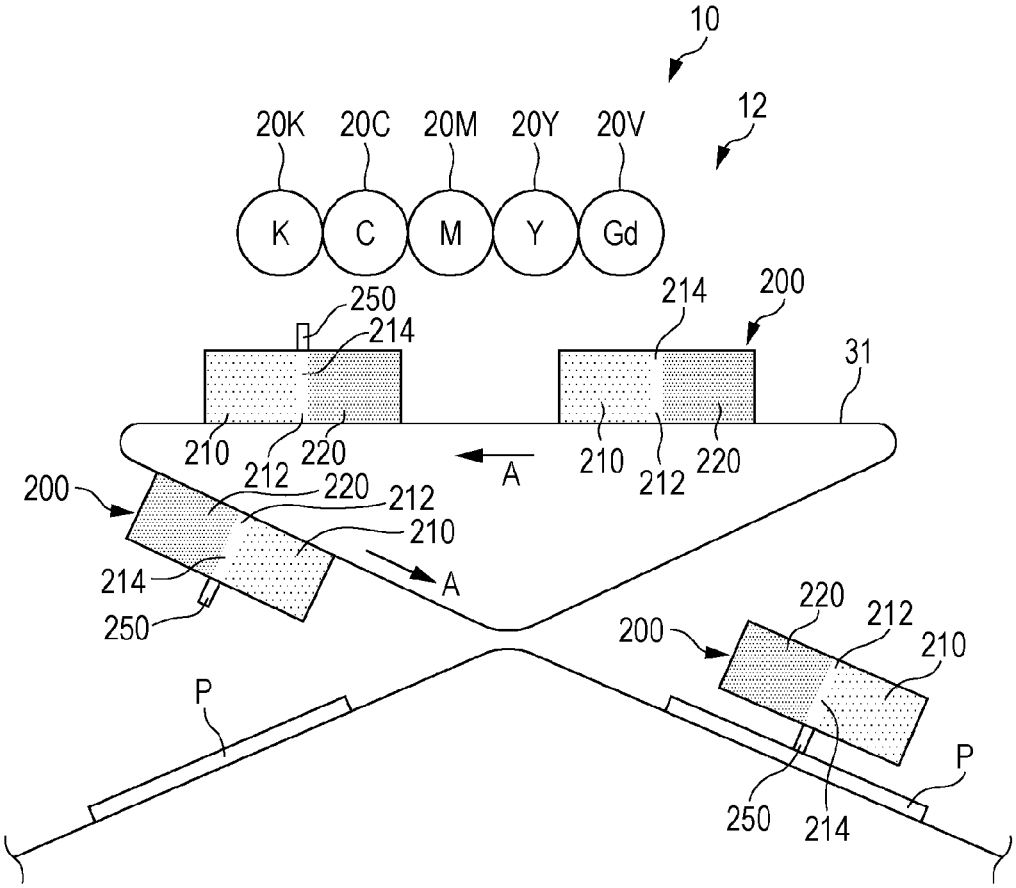
FIG. 4 is an explanatory view illustrating transference of a correction toner image onto a recording medium so as to superpose the correction toner image on a boundary portion of a low-area-coverage portion that is a boundary with a high-area-coverage portion on an upstream side in a gold toner image.

As illustrated in FIGS. 4 and 5, in some cases a gold toner image 200 that has a high-area-coverage portion 220 having a higher area coverage than that of a low-area-coverage portion 210 having a low area coverage is formed adjacent to the low-area-coverage portion 210 upstream of the low-area-coverage portion 210 by the toner image forming unit 20V for the special color (V), that is, gold on the upstream side. When such a gold toner image 200 is formed, the controller 70 (see FIG. 1) causes the toner image forming units 20Y, 20M, 20C, and 20K on the downstream side to transfer a correction toner image 250 so as to superpose the correction toner image 250 on a boundary portion 212 of the low-area-coverage portion 210 that is a boundary with the high-area-coverage portion 220. The details of this control will be described later.

Operation

Next, operation according to the present exemplary embodiment is described.

Initially, a low-density portion 214 generated in the boundary portion 212 of the low-area-coverage portion 210 that is the boundary with the high-area-coverage portion 220 is described in the case where the gold toner image 200 that has the high-area-coverage portion 220 having a higher area coverage than that of the low-area-coverage portion 210 having a low area coverage is formed adjacent to the low-area-coverage portion 210 on the upstream of the low-area-coverage portion 210 by the toner image forming unit 20V for gold. The boundary portion 212 and the low-density portion 214 illustrated in FIGS. 4 and 5 are the same region.

This low-density portion 214 (boundary portion 212) is an edge defect (void) characteristic of the electrophotographic method caused at an image boundary where the area coverage is steeply increased. This defect is thought to be caused by a pickup effect of the counter charge of the carrier GA.

Accordingly, the pickup effect of the counter charge of the carrier GA is described next with reference to FIGS. 6A to 6C.

Figure 6A:
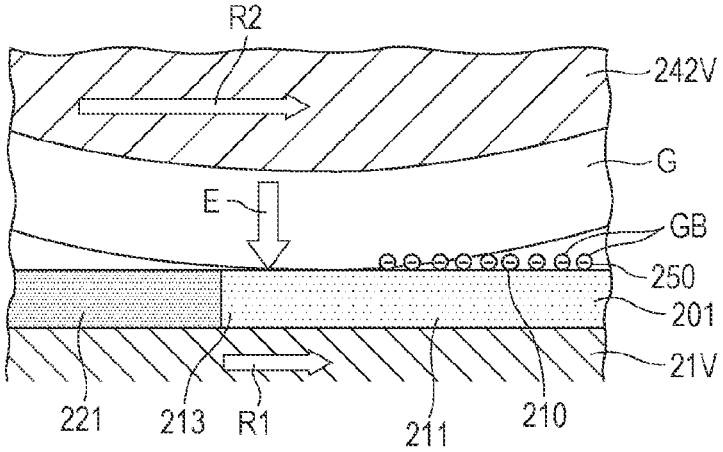
FIGS. 6A to 6C are explanatory views sequentially illustrating in this order how the low-density portion in the boundary portion of the gold toner image is generated by a toner image forming unit for gold.
Figure 6B:
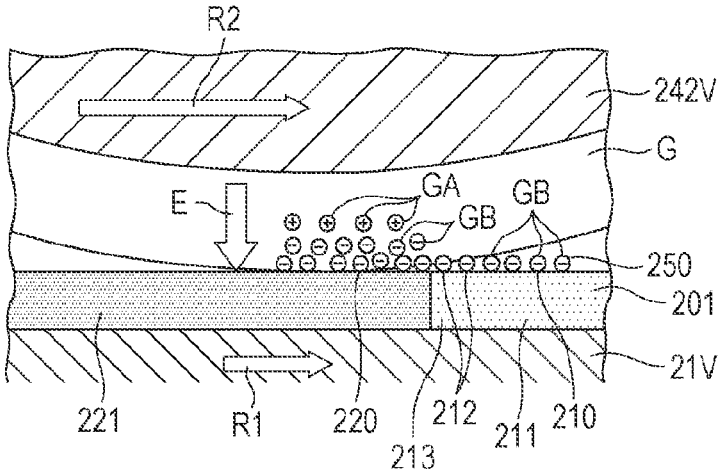
Figure 6C:
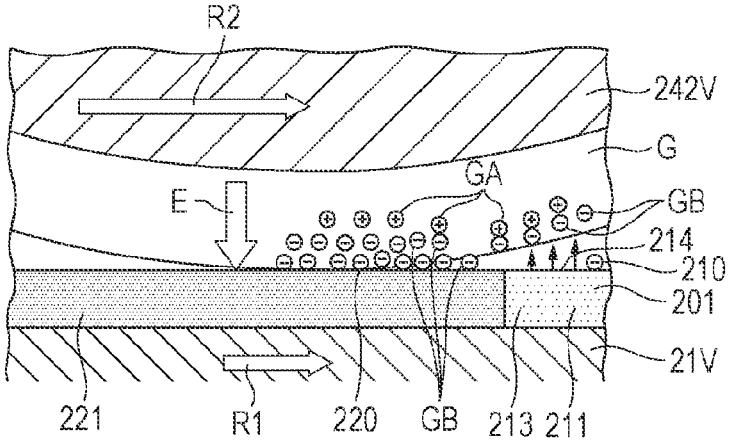

For clarity of understanding, the outer circumferential surface of the photosensitive drum 21V, which actually has an arc shape in sectional view, is illustrated as a line in FIGS. 6A to 6C. Also in FIGS. 6A to 6C, an arrow R1 indicates rotation of the photosensitive drum 21V, an arrow R2 indicates rotation of the developing roller 242V, and an arrow E indicates an electric field.

A latent image 201 formed on the photosensitive drum 21V corresponds to the gold toner image 200, a latent image 211 corresponds to the low-area-coverage portion 210, a latent image 221 corresponds to the high-area-coverage portion 220, and a latent image 213 corresponds to the boundary portion 212.

As illustrated in FIGS. 6A and 6B, when the latent image 221 corresponding to a high area coverage is developed with the developer G, a charge opposite to that of the toner GB, that is, a so-called counter charge remains in the carrier GA.

As described above, the developer G (magnetic brush GC) is moved in the same direction as that of the outer circumferential surface of the photosensitive drum 21 at a higher speed than that of the outer circumferential surface in the nip (portion in contact with the photosensitive drum 21) (see FIG. 3).

Accordingly, referring to FIG. 6C, the developing roller 242V holds the developer G having been used to develop the latent image 221 corresponding to the high-area-coverage portion 220 on the upstream side. This developer G passes the high-area-coverage portion 220 and approaches the low-area-coverage portion 210. When the developer G approaches the low-area-coverage portion 210 on the downstream side as described above, the carrier GA in which the counter charge remains attracts the toner GB in the boundary portion 212 of the previously developed low-area-coverage portion 210 of the photosensitive drum 21V on the upstream side. This moves back the toner GB from the photosensitive drum 21 to the developing roller 242V.

Thus, the low-density portion (void) 214 is generated in the boundary portion 212 of the low-area-coverage portion 210 that is the boundary with the high-area-coverage portion 220.

Thus, according to the present exemplary embodiment, the toner image forming units 20Y, 20M, 20C, and 20K on the downstream side transfer the correction toner image 250 so as to superpose the correction toner image 250 on the boundary portion 212 of the low-area-coverage portion 210 that is the boundary with the high-area-coverage portion 220, that is, the low-density portion 214 of the gold toner image 200 formed by the gold toner image forming unit 20V on the upstream side as illustrated in FIG. 4.

Thus, after the transfer onto the recording medium P has been performed, the correction toner image 250 is provided between the boundary portion 212, that is, the low-density portion 214 and the recording medium P. This may make the image density of the low-density portion 214 (boundary portion 212) appropriate (improve the image density), and accordingly, may reduce the likelihood of the low-density portion 214 (reduction of the density in the boundary portion 212) being visually recognizable (noticeable). Accordingly, compared to the case where the correction toner image 250 is not transferred, the image quality may be improved.

Since a charge amount of the gold toner including the flat metal pigment particles is lower than that of toner including the pigment particles other than metal pigment particles, the carrier GA having a high electrical resistance needs to be used. When the electrical resistance of the carrier GA is high, however, the counter charge is large. This increases the amount of the toner GB moved back to the developing roller 242V (see FIG. 6C), and accordingly, the reduction of the density is increased. Thus, it may be effective to transfer the correction toner image 250 onto the low-density portion 214 of the gold toner image 200 having metallic luster so as to superpose the correction toner image 250 on the low-density portion 214, thereby improving the image quality of the gold toner image 200 having metallic luster.

The area coverages of yellow, magenta, cyan, and black correction toner image components respectively formed by the toner image forming units 20Y, 20M, 20C, and 20K are adjusted so that the color of the correction toner image 250 becomes close to the color of the boundary portion 212, that is, the low-density portion 214 of the low-area-coverage portion 210 with the high-area-coverage portion 220 on the upstream side in the gold toner image 200.

Specifically, when the area coverage of the low-area-coverage portion 210 of the gold toner image 200 is M1, the area coverage of the yellow correction toner image component is M2, the area coverage of the magenta correction toner image component is M3, the area coverage of the cyan correction toner image component is M4, and the area coverage of the black correction toner image component is M5, M2 is set to from M1−15% to M1+5%, that is, (M1−15%)≤M2≤(M1+5%), M3 is set to from 13.3 to 25% of M2, that is, (M2×13.3%)≤M3≤(M2×25%), and M4 and M5 are set to 0%. The upper limit values of M2 and M3 are 100%, and the lower limit values of M2 and M3 are 0%.

Furthermore, the width of the correction toner image 250 in a transport direction (arrow A direction) is set to 0.5 to 1.0 mm.

According to the present exemplary embodiment, M2 is set to M1−5% (M2=M1−5%), M3 is set to ⅙ (1.67%) of M2, that is, (M3=M2/6), and the width of the correction toner image 250 in the transport direction (arrow A direction) is set to 1.0 mm.

Furthermore, the degree of reduction of the density of the boundary portion 212 (low-density portion 214) varies depending on the difference in the area coverage between the low-area-coverage portion 210 and the high-area-coverage portion 220 of the gold toner image 200 and the area coverage values of the low-area-coverage portion 210 and the high-area-coverage portion 220 of the gold toner image 200. Thus, M2 and M3 of the correction toner image 250 may be appropriately adjusted in accordance with the area coverages of the low-area-coverage portion 210 and the high-area-coverage portion 220 of the gold toner image 200. Such adjustment may be performed by any method. For example, M2 and M3 corresponding to the area coverages of the low-area-coverage portion 210 and the high-area-coverage portion 220 of the gold toner image 200 may be obtained in advance and stored in the controller 70.

Here, outer end portions of the developing roller 242 in the axial direction extend further to the outside than end portions of the electrostatic latent image on the photosensitive drum 21 in the axial direction. Thus, the toner GB is moved to and attracted to end portions of the electrostatic latent image in the axial direction also from the outer end portions of the developing roller 242. Accordingly, the amount of toner tends to increase at the end portions than in a central portion of the electrostatic latent image in the axial direction. Thus, the reduction of the density (void) is less likely to occur in end portions than in a central portion of the boundary portion 212 of the gold toner image 200 in the axial direction (end portions in the width direction D (see FIG. 5)). In other words, the degree of reduction of the density is smaller in the end portions than in the central portions of the boundary portion 212 of the gold toner image 200 in the axial direction.

Accordingly, the correction toner image 250 may be set such that the area coverage of the correction toner image 250 is lower near end portions (end portions in the width direction (see FIG. 5)) than in a central portion of the correction toner image 250 in the axial direction. With such a setting, the image density of the end portions of the boundary portion 212 of the gold toner image 200 in the axial direction may be more appropriately corrected, and accordingly, the image quality may be improved.

It is noted that the case of "the area coverage . . . is lower" may be a case of 0% area coverage, that is, a case where parts of the correction toner image at (near) end portions in the axial direction are not transferred. In other words, the length of the correction toner image 250 in the axial direction (width direction D (see FIG. 5)) may be shorter than the length of the boundary portion 212.

Furthermore, since the movement of the toner GB back to the developing roller 242V (see FIG. 6C) increases toward the high-area-coverage portion 220 side (upstream side) in the low-density portion 214 of the gold toner image 200, the reduction of the density increases toward the high-area-coverage portion 220. Accordingly, the correction toner image 250 may be set such that the area coverage of the correction toner image 250 increases from the low-area-coverage portion 210 side (downstream side) toward the high-area-coverage portion 220 side (upstream side). With such a setting, the image density of the low-density portion 214 (boundary portion 212) of the gold toner image 200 may be appropriately corrected, and accordingly, the image quality may be improved.

Experiments

Next, experiments are described. The experiments are performed with the image forming apparatus 10 according to the present exemplary embodiment so as to obtain the area coverages M2 and M3 of the yellow and magenta correction toner image components of the correction toner image and the length of the correction toner image in the transport direction. Each of the experiments is performed in the environment where the temperature is 21° C. and the humidity is 10% RH.

First Experiment

The image quality of the low-density portion 214 (boundary portion 212) is visually checked while the area coverage M2 of the yellow correction toner image component of the correction toner image 250 is varied. The area coverages of the high-area-coverage portion 220 and the low-area-coverage portion (halftone) 210 of the gold toner image 200 are respectively set to 100% and 40%.

A table of FIG. 7 lists evaluation results when the area coverage M2 of the yellow correction toner image component of the correction toner image 250 is values obtained by adding −20%, −15%, −10%, −5%, 0%, +5%, and +10% to the area coverage M1 of the low-area-coverage portion 210 of the gold toner image 200. In the table, the evaluation result "A" indicates that the low-density portion 214 (boundary portion 212) is almost visually unrecognized or visually unrecognized, and the evaluation result "B" indicates that the low-density portion 214 (boundary portion 212) is visually recognized and noticeable.

The area coverage M3 of the magenta correction toner image component is set to ⅙ (1.67%) of M2. The length of the correction toner image 250 in the transport direction is set to 1.0 mm.

As illustrated in this table of FIG. 7, when M2 is the values obtained by adding −15% to +5% to M1, the density of the low-density portion (void) 214 is increased. This may improve the image quality.

Second Experiment

The image quality of the low-density portion 214 (boundary portion 212) is visually checked while the length of the correction toner image 250 in the transport direction is varied. The area coverages of the high-area-coverage portion 220 and the low-area-coverage portion (halftone) 210 of the gold toner image 200 are respectively set to 100% and 40%.

Figures 8, 9:
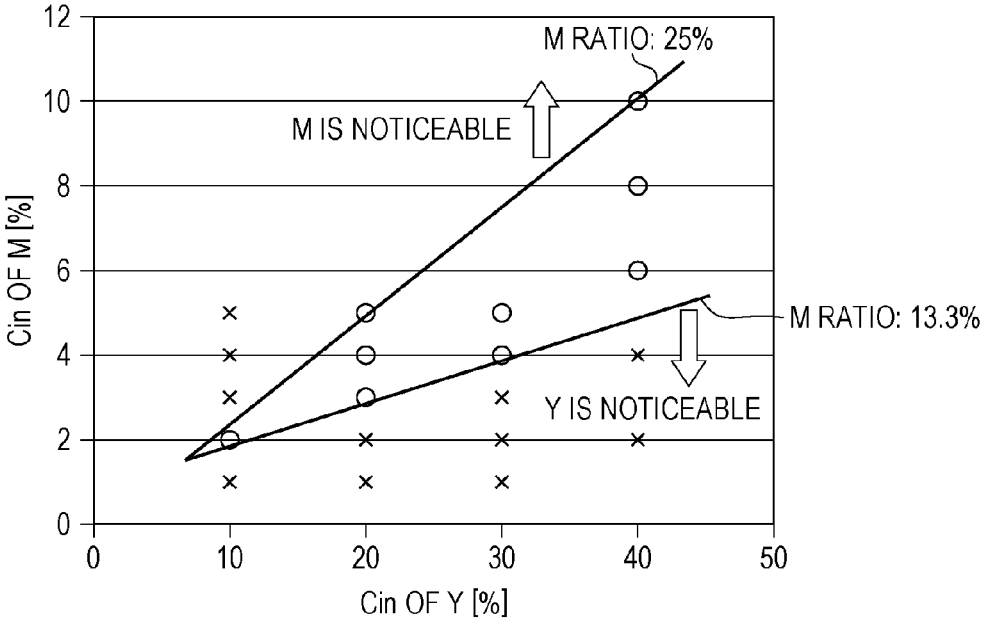
FIG. 8 is a table that summarizes results of a second experiment.
FIG. 9 is a graph that summarizes results of a third experiment.

A table of FIG. 8 illustrates evaluation results when the length of the correction toner image 250 in the transport direction is set to 0.5 mm, 1.0 mm, and 1.5 mm. In the table, the evaluation result "A" indicates that the low-density portion 214 (boundary portion 212) is almost visually unrecognized or visually unrecognized, and the evaluation result "B" indicates that the low-density portion 214 (boundary 212) or the correction toner image 250 is visually recognized and noticeable.

The area coverage M2 of the yellow correction toner image component is set to 30% (M1−10%), and M3 is set to ⅙(1.67%) of M2.

As illustrated in this table of FIG. 8, when the length is 0.5 mm or 1.0 mm, the image density of the low-density portion (void) 214 is increased. This may improve the image quality. When the length is 1.5 mm, the image density of the low-density portion (void) 214 is increased. However, the correction toner image 250 extends toward the downstream side beyond the low-density portion 214. Thus, the correction toner image 250 may become noticeable and the image quality may be degraded.

Third Experiment

When the area coverage of the high-area-coverage portion 220 of the gold toner image 200 is 100%, the color of the low-density portion 214 (boundary portion 212) of the low-area-coverage portion (halftone) 210 and the color of the correction toner image 250 are visually compared. Although the colors are visually compared according to the present exemplary embodiment, the colors may be measured by a measuring device such as a colorimeter and compared.

The area coverage M1 of the low-area-coverage portion 210 of the gold toner image 200 is set to 10%, 20%, 30%, and 40%.

The area coverage M2 of the yellow correction toner image component is set to the same values as those of M1, that is, 10%, 20%, 30%, and 40%. The correction toner image 250 is created by superposing the magenta correction toner image component the area coverage of which is 1%, 2%, 3%, 4%, 5%, 6%, 8%, and 10% on the yellow correction toner image component. The color of the low-density portion 214 of the gold toner image 200 is visually compared. The experiment is not performed on some of the combinations of the area coverages.

As illustrated in a graph of FIG. 9, when the area coverage M3 of the magenta correction toner image component is higher than 25% of the area coverage M2 of the yellow correction toner image component, magenta (M) is noticeable, and when M3 is lower than 13.3% of the area coverage M2, yellow is noticeable. Accordingly, when the area coverage M3 of the magenta correction toner image component is from 13.3 to 25% of M2, a color close to that of the low-density portion 214 of the gold toner image 200 is obtained.

Variations

Exemplary embodiments of the present invention are not limited to the aforementioned exemplary embodiment.

For example, although the toner GB of the toner image forming unit 20V for the special color (V) as an example of the toner image forming unit on the upstream side is the gold toner, this is not limiting. This toner GB of the toner image forming unit 20V may be silver toner that includes metal pigment particles that each serve as an example of the flat pigment. Alternatively, the toner GB of the toner image forming unit 20V may be, for example, orange, violet, green, light cyan, light magenta, white, or transparent toner that includes pigment particles other than flat pigment particles.

As is the case with the gold toner, reduction of the density in the boundary portion is increased when the silver toner that includes the flat metal pigment particles is used. Accordingly, it may also be effective to transfer the correction toner image onto the boundary portion (low-density portion) so as to superpose the correction toner image on the boundary portion, thereby improving the image quality.

A toner image of the special color (V) of the toner image forming unit 20V on the upstream side other than gold may also have a similar low-density portion. For a correction toner image in this case, the area coverages of the correction toner image components to be transferred by the toner image forming units 20Y, 20M, 20C, and 20K may be appropriately adjusted so that the color of the correction toner image becomes close to the color of the boundary portion (low-density portion) in a low-area-coverage portion of the toner image formed of the toner for the special color (V) and transferred onto the intermediate transfer belt 31.

Furthermore, when a toner image formed by the toner image forming units 20Y, 20M, or 20C has a similar low-density portion, correction toner may be transferred by the toner image forming unit 20 or the toner image forming units 20 on the downstream side. Also in this case, the area coverage of the correction toner image component or the area coverages of the correction toner image components to be transferred by the toner image forming unit 20 or the toner image forming units 20 on the downstream side may be appropriately adjusted so that the color of the correction toner image becomes close to the color of a boundary portion (low-density portion) in a low-area-coverage portion of the toner image.

In short, it is sufficient that, when the high-area-coverage portion which has a higher area coverage than that of the low-area-coverage portion having a low area coverage is formed adjacent to the low-area-coverage portion on the upstream side in a toner image transferred onto the intermediate transfer body by the toner image forming unit on the upstream side, control be performed so as to transfer the correction toner image by the toner image forming unit or the toner image forming units disposed downstream of the toner image forming unit on the upstream side so that the correction toner image is superposed on the boundary portion of the low-area-coverage portion that is the boundary with the high-area-coverage portion.

Furthermore, the structure of the image forming apparatus is not limited to that of the aforementioned exemplary embodiment. The image forming apparatus may have any one of a variety of structures. For example, instead of the intermediate transfer belt, any one of other intermediate transfer bodies such as an intermediate transfer roller may be used. Instead of transferring an image onto the intermediate transfer body through the first transfer and transferring onto the recording medium P through the second transfer, the image may be directly transferred onto the recording medium P without using the intermediate transfer body.

Alternatively, the image forming apparatus may be a so-called rotary developing-type image forming apparatus that includes a rotary developing mechanism in which the developing devices are disposed along a circumference. The developing devices are sequentially changed over by rotating the rotary developing mechanism, thereby causing each of the developing devices to face a corresponding one of photo sensitive bodies (image holding bodies) on which an electrostatic latent image for a corresponding one of colors is formed and to develop the electrostatic latent image with the toner of the corresponding one of the colors. In this case, when a toner image to be corrected is formed by developing the low-area-coverage portion having a low area coverage and then developing the high-area-coverage portion having a higher area coverage than that of the low-area-coverage portion disposed adjacent to the low-area-coverage portion by using a particular one of the developing devices, control may be performed so that the correction toner image is transferred by the other developing device or the other developing devices so as to be superposed on the boundary portion of the low-area-coverage portion that is the boundary with the high-area-coverage portion in the toner image to be corrected.

When this is described from another viewpoint, with respect to the order of development, when the toner image to be corrected is formed by developing the low-area-coverage portion having a low area coverage before and then developing the high-area-coverage portion having a higher area coverage than that of the low-area-coverage portion disposed adjacent to the low-area-coverage portion, the control may be performed so that the correction toner image is transferred so as to be superposed on the boundary portion of the low-area-coverage portion that is the boundary with the high-area-coverage portion in the toner image to be corrected after the toner image to be corrected has been transferred onto a transfer target.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that transfers a toner image to a transfer target and that includes a plurality of developing units that include a first developing unit and at least one second developing unit and that each include an image holding body that has an outer circumferential surface and that is rotated, and a developing roller that holds developer, that faces the image holding body, and that is rotated in an opposite direction to a rotating direction of the image holding body such that an outer circumferential speed of the developing roller is higher than an outer circumferential speed of the image holding body, and a controller that controls the image forming section so that, when a low-area-coverage portion having a low area coverage and a high-area-coverage portion having a higher area coverage than the low area coverage are disposed adjacent to each other and are formed by the first developing unit, a correction toner image is superposed on a boundary portion, where the low-area-coverage portion and the high-area-coverage portion are adjacent to each other, by the at least one second developing unit.

2. The image forming apparatus according to claim 1, wherein an area coverage of the correction toner image is lower at an end portion than in a central portion in an axial direction of the image holding body.

3. The image forming apparatus according to claim 1, wherein an area coverage of the correction toner image increases from a low-area-coverage portion side toward a high-area-coverage portion side.

4. The image forming apparatus according to claim 3, wherein the at least one second developing unit includes a developing unit for yellow toner that uses developer containing yellow toner, a developing unit for magenta toner that uses developer containing magenta toner, and a developing unit for cyan toner that uses developer containing cyan toner.

5. The image forming apparatus according to claim 4, wherein the controller causes the correction toner image to be formed by adjusting an area coverage of a yellow correction toner image component formed by the developing unit for yellow toner, an area coverage of a magenta correction toner image component formed by the developing unit for magenta toner, and an area coverage of a cyan correction toner image component formed by the developing unit for cyan toner so that a color of the correction toner image becomes close to a color of the boundary portion of the low-area-coverage portion with the high-area-coverage portion.

6. The image forming apparatus according to claim 5, wherein the first developing unit uses developer containing flat pigment toner that includes a flat pigment.

7. The image forming apparatus according to claim 6, wherein the flat pigment toner is a gold toner containing a metal pigment as the flat pigment, and wherein, when the area coverage of the low-area-coverage portion of the toner image to be corrected formed by the developing unit for gold toner is M1, an area coverage of the yellow correction toner image component is M2, an area coverage of the magenta correction toner image component is M3, and an area coverage of the cyan correction toner image component is M4, M2 is set to from M1−15% to M1+5%, M3 is set to from 13.3 to 25% of M2, M4 is set to 0%, and a length of the correction toner image in a transport direction is set to from 0.5 to 1.0 mm.

* * * * *